US009475331B2

(12) United States Patent
Muraoka

(10) Patent No.: US 9,475,331 B2
(45) Date of Patent: Oct. 25, 2016

(54) PLATE PRINTING METHOD WITH BLANKET CLEANING

(71) Applicant: SHUHOU CO., LTD., Fukui-shi, Fukui (JP)

(72) Inventor: Kouji Muraoka, Sabae (JP)

(73) Assignee: SHUHOU CO, LTD., Fukui-Shi, Fukui (JP)

( * ) Notice: Subject to any disclaimer, the term of this patent is extended or adjusted under 35 U.S.C. 154(b) by 0 days.

(21) Appl. No.: 14/412,895

(22) PCT Filed: Sep. 30, 2013

(86) PCT No.: PCT/JP2013/076574

§ 371 (c)(1),
(2) Date: Jan. 5, 2015

(87) PCT Pub. No.: WO2014/162622

PCT Pub. Date: Oct. 9, 2014

(65) Prior Publication Data

US 2015/0158321 A1 Jun. 11, 2015

(30) Foreign Application Priority Data

Apr. 1, 2013 (JP) ..... 2013-075717

(51) Int. Cl.

| | |
|---|---|
| ***B41F 35/06*** | (2006.01) |
| ***B41N 3/00*** | (2006.01) |
| ***B41M 1/02*** | (2006.01) |
| ***B41M 1/04*** | (2006.01) |
| ***B41M 1/10*** | (2006.01) |
| ***B41F 35/00*** | (2006.01) |
| ***B41F 17/00*** | (2006.01) |
| ***B41F 17/24*** | (2006.01) |

(52) U.S. Cl.

CPC ..... *B41N 3/00* (2013.01); *B41F 17/001* (2013.01); *B41F 17/24* (2013.01); *B41F 35/00* (2013.01); *B41F 35/06* (2013.01); *B41M 1/02* (2013.01); *B41M 1/04* (2013.01); *B41M 1/10* (2013.01); *B41P 2235/21* (2013.01)

(58) Field of Classification Search

CPC .. B41P 2235/21; B41P 2200/31; B41N 3/00; B41F 17/001; B41F 17/24; B41F 35/00; B41F 9/12; B41F 9/01; B41F 35/06

See application file for complete search history.

(56) References Cited

FOREIGN PATENT DOCUMENTS

| | | |
|---|---|---|
| CN | 1958300 A | 5/2007 |
| CN | 100564055 C | 12/2009 |

(Continued)

OTHER PUBLICATIONS

Translation of JP 59-202856 A, published Nov. 16, 1984.*

(Continued)

*Primary Examiner* — Jennifer Simmons
(74) *Attorney, Agent, or Firm* — Ladas & Parry LLP

(57) ABSTRACT

A plate printing method includes a repetition of a first step of depositing ink on a printing master to form a predetermined print pattern on it, a second step of transferring the ink to a blanket, a third step of pressing the blanket against a surface to be printed, a fourth step of pressing the blanket against a cleaning surface, a fifth step of pressing the blanker against an absorbent, a sixth step of blowing air to the blanket, and a seventh step of pressing the blanket against a dry surface. In the first step, the blanket with a proper amount of water or solvent impregnated into it is pressed against the printing master.

11 Claims, 4 Drawing Sheets

(56) References Cited

FOREIGN PATENT DOCUMENTS

| | | | | |
|---|---|---|---|---|
| CN | 102059869 | A | | 5/2011 |
| EP | 2 561 988 | A1 | | 2/2013 |
| JP | 59-202856 | A | | 11/1984 |
| JP | 61-24452 | A | | 2/1986 |
| JP | 2000-168033 | A | | 6/2000 |
| JP | 2003-25546 | A | | 1/2003 |
| JP | 2007-526155 | A | | 9/2007 |
| JP | 2009-172835 | A | | 8/2009 |
| JP | 2012020525 | A | * | 2/2012 |

OTHER PUBLICATIONS

Translation of JP 61-24452 A, published Feb. 3, 1986.*
English_Abstract_of_JPA_59-202856 A, Nov. 16, 1984.
English_Abstract_of_JPA_61-024452 A, Feb. 3, 1986.
Machine_English _Translation_of_JPA_2007-526155 A, Sep. 13, 2007.
Abstract_and_Machine_English_Translation_of_JPA_2009-172835 A, Aug. 6, 2009.
Espacenet English abstract of JP 2012-20525 A.
Espacenet English abstract of CN 102059869 A.
Espacenet English abstract of CN 100564055 C.
Office Action dated May 20, 2016 for corresponding Korean Application No. 10-2014-7034797 with English translation.
English abstract of JP 2003-25546 A.
J-PlatPat English abstract of JP 2000-168033 A.
Office Action dated Jun. 30, 2016 for corresponding Chinese Application No. 201380035226.9 with English translation.
Office Action dated Sep. 13, 2016 for Japanese Application No. 2013-075717.

* cited by examiner

THIRD STEP

FOURTH STEP

FIFTH STEP

SIXTH STEP

SEVENTH STEP

PLATE PRINTING METHOD WITH BLANKET CLEANING

RELATED APPLICATION INFORMATION

This application is a 371 of International Application PCT/JP2013/076574 filed 30 Sep. 2013, which was published on 9 Oct. 2014, with International Publication Number WO 2014/162622 A1, and which claims priority from Japanese Patent Application 2013-075717 filed 1 Apr. 2013, the content of which is incorporated herein by reference.

TECHNICAL FIELD

The present invention relates to a plate printing method and, more particularly, to a plate printing method (relief printing and intaglio printing will be collectively referred to as "plate printing" hereinafter) using a blanket.

BACKGROUND ART

Conventionally, a plate printing method is a method of printing a print pattern on a surface to be printed by pressing a blanket (or a pad) against a printing master (or a printing plate) on which ink corresponding to the print pattern is placed, transferring (supplying) the ink in the print pattern to the printing pad, pressing the printing pad against the surface to be printed, and transferring (delivering) the transferred ink to the surface to be printed. An invention in which ink in an ink box in contact with a printing master is shaken and agitated by a reciprocating motion of the printing master to make the ink harder to solidify in order to prevent degradation in the printing quality is disclosed (see, for example, Patent Literature 1).

CITATION LIST

Patent Literature

Patent Literature 1: Japanese Unexamined Patent Application Publication No. 2008-114498 (pp. 9 & 10, FIG. 1)

SUMMARY OF INVENTION

Technical Problem

The invention disclosed in Patent Literature 1 can make the ink harder to solidify by agitating it, but has problems to be described below. That is, because the blanket (or a pad) is made of a mixture of silicone rubber, when the ink is hard (for example, 88 PaS or more), the transfer performance of transferring the ink to the surface to be printed is poor. To obtain satisfactory transfer performance, it is necessary to soften the ink. If the ink is softened, the printing master (printing plate) is easily contaminated and this increases the load of maintenance of the printing master (printing plate). Therefore, hard ink is preferably used. This makes it difficult to achieve both satisfactory transfer performance and cleanliness of the printing master.

The present invention has been made to solve the above problems, and can provide a plate printing method which can achieve both satisfactory transfer performance and cleanliness of a printing master.

Solution to Problem (1) A plate printing method according to the present invention includes a repetition of a first step of depositing ink on a printing master to form a predetermined print pattern thereon, a second step of pressing a blanket against the printing master with the ink deposited thereon and transferring the ink to the blanket, a third step of pressing the blanket with the ink transferred thereon against a surface to be printed and transferring the ink from the blanket to the surface to be printed, a fourth step of pressing the blanket after the ink is transferred to the surface to be printed against a fiat cleaning surface and depositing the ink remaining in the blanket on the cleaning surface, and a fifth step of pressing the blanket after the remaining ink is deposited on the cleaning surface against an absorbent and depositing or impregnating a part of water or a solvent impregnated into the absorbent on or into the blanket.

(2) The plate printing method further includes a sixth step of, after the fifth step, blowing air to the blanket with the part of the water or solvent deposited thereon or impregnated thereinto and removing a part of the water or solvent deposited on or impregnated into the blanket.

(3) The plate printing method further includes a seventh step of, after the fifth step or the sixth step, pressing the blanket against a flat dry surface and removing a part of the water or solvent deposited on or impregnated into the blanket from the blanket.

(4) The plate printing method further includes a starting first step of, before the first step, pressing the blanket against the absorbent and depositing or impregnating a part of the water or solvent impregnated into the absorbent on or into the blanket.

(5) The plate printing method further includes a starting second step of, after the starting first step, blowing air to the blanket with the part of the water or solvent deposited thereon or impregnated thereinto and removing a part of the water or solvent deposited on or impregnated into the blanket.

(6) The plate printing method further includes a starting third step of, after one of the starting first step and the starting second step, pressing the blanket against the fiat dry surface and removing a part of the water or solvent deposited on or impregnated into the blanket from the blanket.

(7) The absorbent includes a stack of sheets of paper.

(8) The cleaning surface is a surface of paper or an adhesive surface of adhesive tape.

Advantageous Effects of Invention (i) In the plate printing method according to the present invention, with the above-mentioned configuration, a proper amount of water or solvent is deposited on or impregnated into the blanket. Thus, even with hard ink, the transfer performance does not deteriorate. The use of hard ink allows the printing master (printing plate) to be maintained clean, thus facilitating the maintenance of the printing master (printing plate).

DESCRIPTION OF EMBODIMENTS

Figure 1:
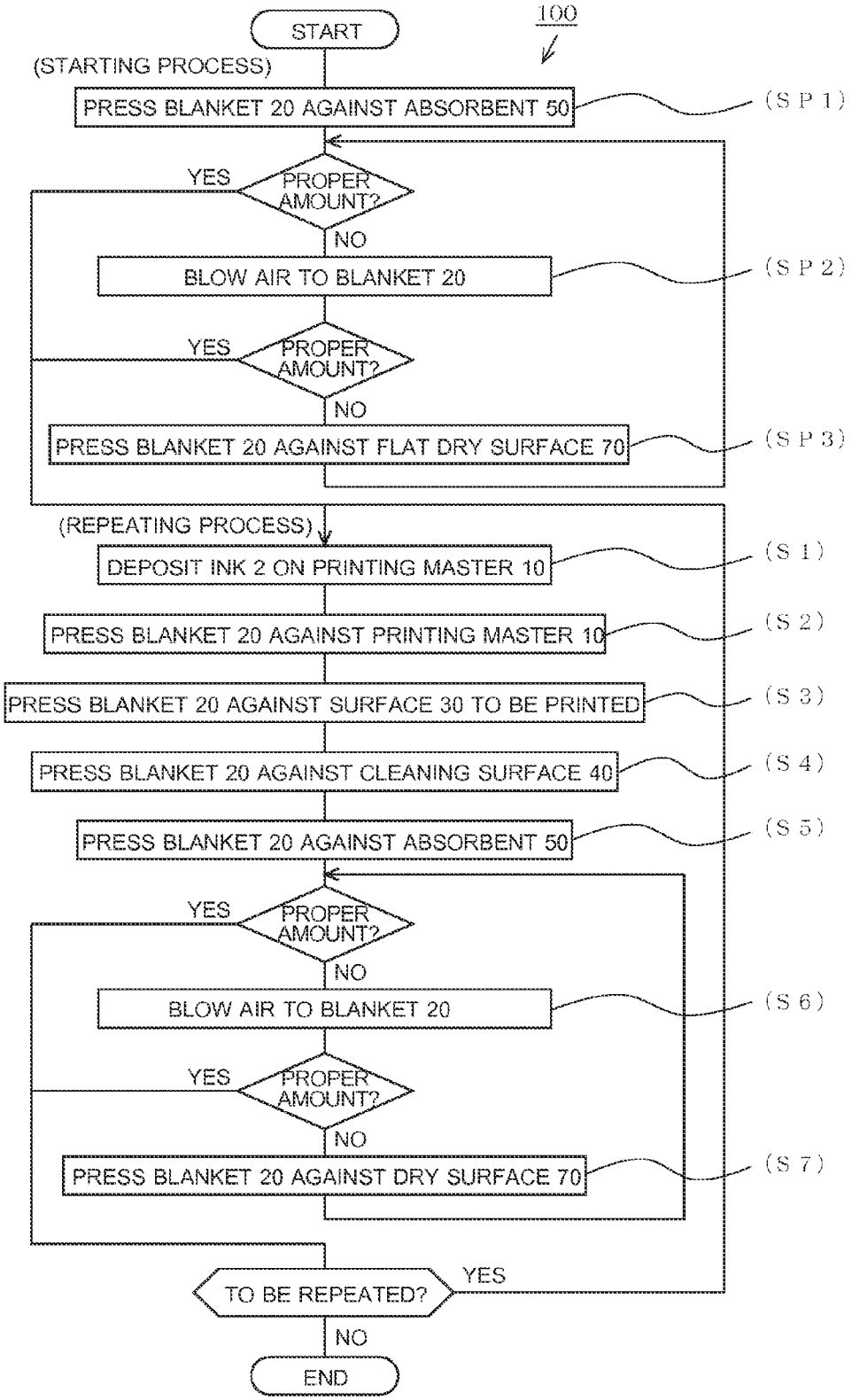
FIG. 1 is a flowchart that illustrates a sequence of operations describing a plate printing method according to Embodiment 1 of the present invention.

FIGS. 1 to 8 are illustrations for describing a plate printing method according to Embodiment 1 of the present invention. FIG. 1 is a flowchart that illustrates a sequence of operations. FIGS. 2 to 8 are side views that schematically illustrate statuses of the operations.

Referring to FIG. 1, a plate printing method 100 includes a starting process and a repeating process.

(Starting Process)

The starting process includes a starting first step (SP1) of pressing a blanket 20 against an absorbent 50 and depositing or impregnating a part of water or a solvent impregnated into the absorbent 50 on or into the blanket 20, a starting second step (SP2) of blowing air to the blanket 20 with the part of the water or solvent deposited on or impregnated into it using air-blowing means 60 and removing a part of the water or solvent deposited on or impregnated into the blanket 20, and a starting third step (SP3) of pressing the blanket 20 against a fiat dry surface 70 and removing a part of the water or solvent deposited on or impregnated into the blanket 20 from the blanket 20.

When a proper amount of water or solvent is deposited on or impregnated into the blanket 20, one or both of the starting second step (SP2) and the starting third step (SP3) may be omitted.

(Repeating Process)

The repeating process includes a first step (S1) of depositing ink 2 on a printing master 10 to form a predetermined print pattern 1 on it, a second step (S2) of pressing the blanket 20 against the printing master 10 with the ink 2 deposited in the print pattern 1 and transferring the ink 2 to the blanket 20, a third step (S3) of pressing the blanket 20 with the ink 2 transferred on it against a surface 30 to be printed and transferring the ink 2 from the blanket 20 to the surface 30 to be printed, and a fourth step (S4) of pressing the blanket 20 after the ink 2 is transferred to the surface 30 to be printed against a fiat cleaning surface 40 and depositing the ink 2 remaining in the blanket 20 on the cleaning surface 40.

The repeating process further includes a fifth step (S5) of pressing the blanket 20 after the remaining ink 2 is deposited on the cleaning surface 40 against the absorbent 50 and depositing or impregnating a part of the water or solvent impregnated into the absorbent 50 on or into the blanket 20, a sixth step (S6) of blowing air to the blanket 20 with the part of the water or solvent deposited on or impregnated into it using the air-blowing means 60 and removing a part of the water or solvent deposited on or impregnated into the blanket 20, and a seventh step (S7) of, after the fifth step (S5) or the sixth step (S6), pressing the blanket 20 against the flat dry surface 70 and removing a part of the water or solvent deposited on or impregnated into the blanket 20 from the blanket 20.

When a proper amount of water or solvent is deposited on or impregnated into the blanket 20, one or both of the sixth step (S6) and the seventh step (S7) may be omitted.

(Operational Status)

In the first step, a method of depositing the ink 2 on the printing master 10 to form the predetermined print pattern 1 on it is not limited, and may be so-called relief printing or intaglio printing.

Figure 2:
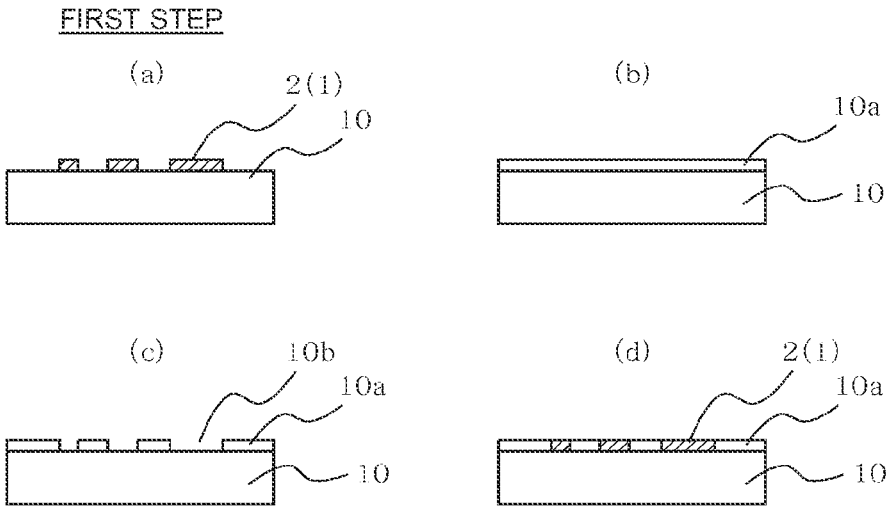
FIG. 2 shows side views of statuses of an operation (first step) in the sequence of operations illustrated in FIG. 1.

In (a) of FIG. 2, the ink 2 is applied to almost the entire surface of the printing master 10 with a uniform thickness, the ink 2 applied on almost the entire surface is partly removed, and the remaining ink 2 (thick films are highlighted as hatched portions) is the print pattern 1 (relief printing). Water or another material corresponding to the print pattern 1 may be impregnated into the printing master 10, so that the ink 2 is repelled partially.

In (b) of FIG. 2, a masking material 10*a* is placed on the entire surface of the printing master 10, in (c) of FIG. 2, recesses 10*b* corresponding the print pattern 1 are formed in the masking material 10*a*, and in (d) of FIG. 2, the recesses 10*b* are filled with the ink 2 (intaglio printing). A silicone agent or another material corresponding to the print pattern 1 may be applied to the printing master 10, so that the ink 2 is repelled partially.

Figure 3:
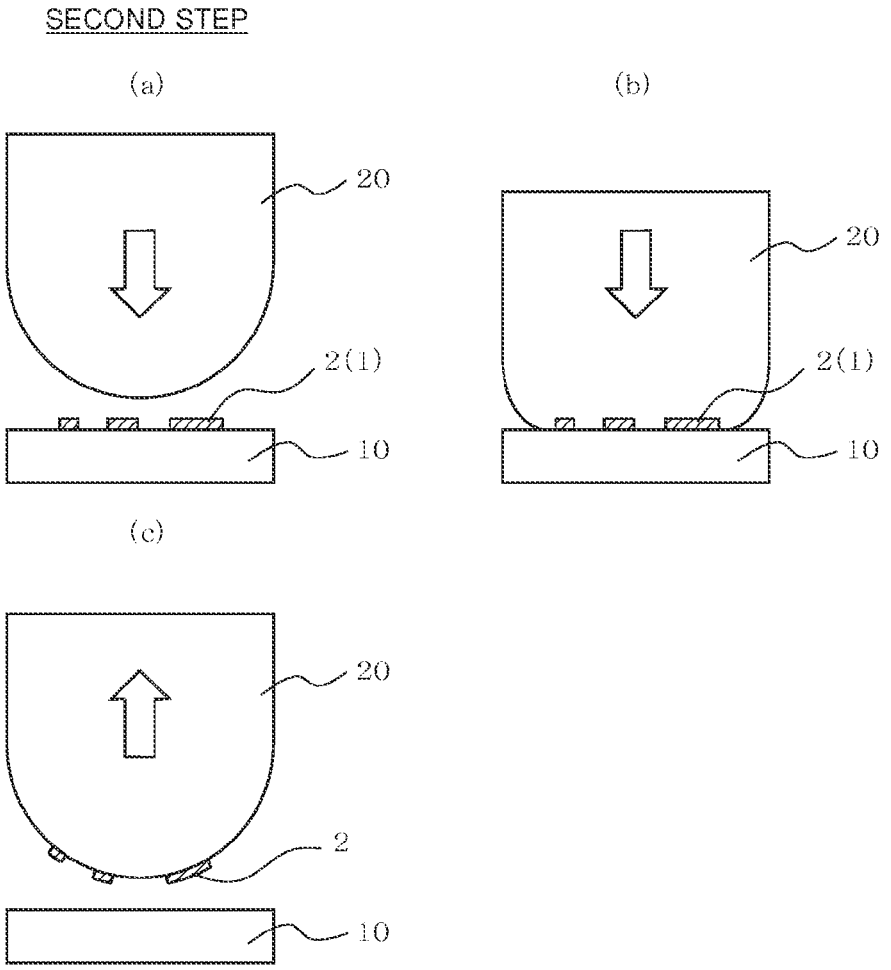
FIG. 3 shows side views of statuses of an operation (second step) in the sequence of operations illustrated in FIG. 1.

In (a) to (c) of FIG. 3, in the second step (S2), the blanket 20 is pressed against the printing master 10 with the ink 2 deposited in the print pattern 1, and the ink 2 is transferred to the blanket 20.

Figure 4:
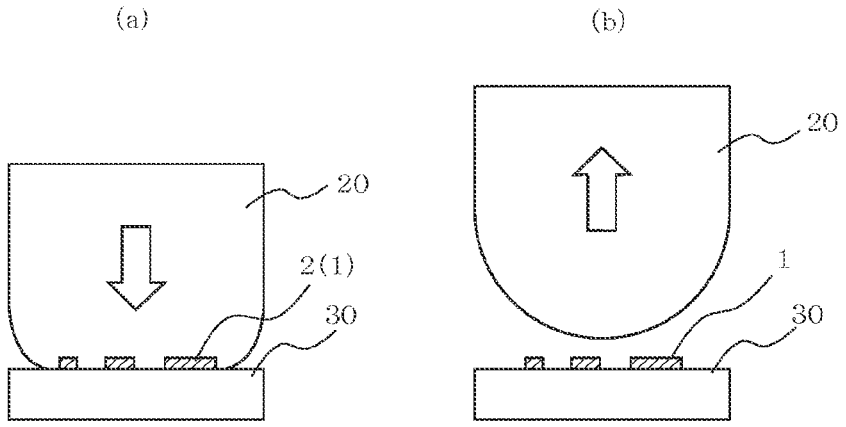
FIG. 4 shows side views of statuses of an operation (third step) in the sequence of operations illustrated in FIG. 1.

In (a) and (b) of FIG. 4, in the third step (S3), the blanket 20 with the ink 2 transferred on it is pressed against the surface 30 to be printed, and the ink 2 is transferred from the blanket 20 to the surface 30 to be printed. The surface 30 to be printed is illustrated as a planar surface, but is not limited to this, and may be a nonplanar (curved) surface.

Figure 5:
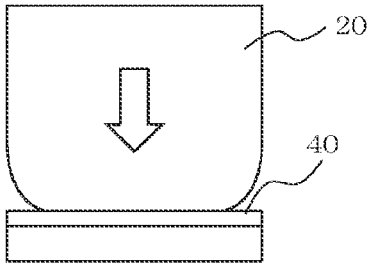
FIG. 5 is a side view that illustrates a status of an operation (fourth step) in the sequence of operations illustrated in FIG. 1.

In FIG. 5, in the fourth step (S4), the blanket 20 after the ink 2 is transferred to the surface 30 to be printed is pressed against the flat cleaning surface 40, and the ink 2 remaining in the blanket 20 is deposited on the cleaning surface 40. The cleaning surface 40 is a surface of paper or adhesive tape, but is not limited to this.

Figure 6:
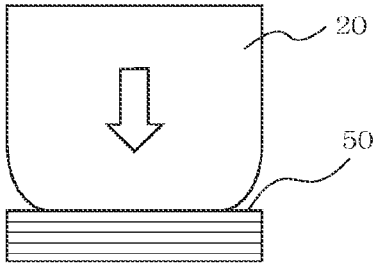
FIG. 6 is a side view that illustrates a status of an operation (fifth step) in the sequence of operations illustrated in FIG. 1.

In FIG. 6, in the fifth step (S5), the blanket 20 after the cleaning operation is pressed against the absorbent 50, and a part of the water or solvent impregnated into the absorbent 50 is deposited on or impregnated into the blanket 20. One example of the absorbent 50 is an absorbent in which water or a solvent is impregnated (soaked) into a stack of about 50 sheets of paper. However, the absorbent 50 is not limited to paper, and may be any type of material capable of absorbing moisture. The absorbent 50 need not be a stack of sheets, and may be a single sheet (single layer).

An appropriate type of solvent is selected in accordance with its properties with respect to the ink 2, and may be a material having the property of softening hard ink 2. This material is, for example, a thinner, xylene, or toluene, but is not limited to them.

Figure 7:
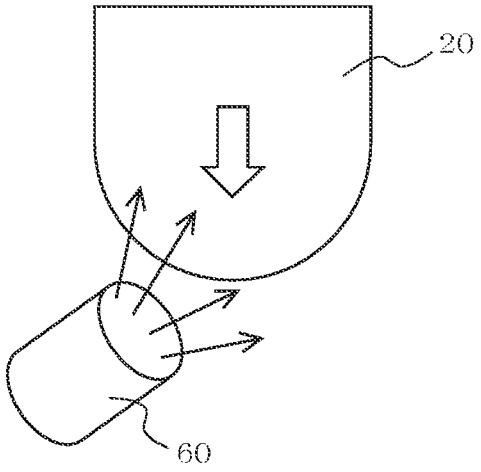
FIG. 7 is a side view that illustrates a status of an operation (sixth step) in the sequence of operations illustrated in FIG. 1.

In FIG. 7, in the sixth step (S6), air is blown by the air-blowing means 80 to the blanket 20 with the part of the water or solvent deposited on or impregnated into it, and a part of the water or solvent deposited on or impregnated into the blanket 20 is removed. The type and number of air-blowing means 80 and the direction in which air is blown are not limited.

Figure 8:
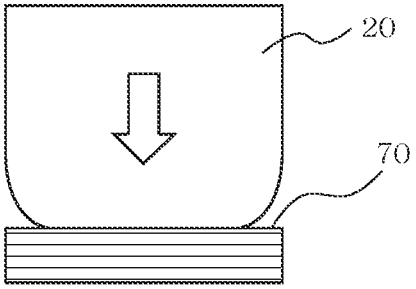
FIG. 8 is a side view that illustrates a status of an operation (seventh step) in the sequence of operations illustrated in FIG. 1.

In FIG. 8, in the seventh step (S7), the blanket 20 is pressed against the flat dry surface 70, and a part of the water or solvent deposited on or impregnated into the blanket 20 is removed from the blanket 20. The dry surface 70 is a surface of a stack of sheets of dried paper, but is not limited to a surface of paper, and may be a surface of any type of material capable of absorbing moisture. The dry surface 70 need not be a surface of a stack of sheets, and may be a single-sheet surface (single layer).

The starting first step (SP1), starting second step (SP2), and starting third step (SP3) in the starting process are the same as the fifth step (S5), sixth step (S6), and seventh step (S7), respectively, in the repeating process, and a description thereof will not be given herein.

(Advantages)

As described above, in the plate printing method 100, the blanket 20 with a proper amount of water or solvent impregnated into it (or deposited on it) receives the ink 2 from the printing master 10 and delivers the ink 2 to the surface to be printed.

Accordingly, even when the blanket 20 receives hard ink 2 (as hard as, for example, 200 PaS or more) from the printing master 10, the ink 2 softened moderately can be delivered to the surface to be printed. Thus even when hard ink 2 is used, the transfer performance does not deteriorate. The use of hard ink 2 makes the printing master less likely to be contaminated.

INDUSTRIAL APPLICABILITY

According to the present invention, even with hard ink, both satisfactory transfer performance and cleanliness of the printing master can be maintained. Thus the aforementioned plate printing method can be widely used in employing blankets having various shapes and sizes.

REFERENCE SIGNS LIST

1 print pattern 2 ink 10 printing master 10*a* masking material 10*b* recess 20 blanket 30 surface to be printed 40 cleaning surface 50 absorbent 60 air-blowing means 70 dry surface 100 plate printing method

The invention claimed is:

1. A plate printing method comprising a repetition of:

a first step of depositing ink on a printing master to form a predetermined print pattern thereon;

a second step of pressing a blanket against the printing master with the ink deposited thereon and transferring the ink to the blanket;

a third step of pressing the blanket with the ink transferred thereon against a surface to be printed and transferring the ink from the blanket to the surface to be printed;

a fourth step of pressing the blanket after the ink is transferred to the surface to be printed against a flat cleaning surface and depositing the ink remaining in the blanket on the cleaning surface; and a fifth step of pressing the blanket after the remaining ink is deposited on the cleaning surface against an absorbent and depositing or impregnating a part of water or a solvent impregnated into the absorbent on or into the blanket, the method also comprising another step of, after the fifth step, pressing the blanket against a flat dry surface and removing a part of the water or solvent deposited on or impregnated into the blanket from the blanket.

2. The plate printing method of claim 1, further comprising a sixth step of, after the fifth step, blowing air to the blanket with the part of the water or solvent deposited thereon or impregnated thereinto and removing a part of the water or solvent deposited on or impregnated into the blanket.

3. The plate printing method of claim 1, further comprising a starting first step of, before the first step, pressing the blanket against the absorbent and depositing or impregnating a part of the water or solvent impregnated into the absorbent on or into the blanket.

4. The plate printing method of claim 3, anther comprising a starting second step of, after the starting first step, blowing air to the blanket with the part of the water or solvent deposited thereon or impregnated thereinto and removing a part of the water or solvent deposited on or impregnated into the blanket.

5. The plate printing method of claim 4, further comprising a starting third step of, after the starting first step, pressing the blanket against the flat dry surface and removing a part of the water or solvent deposited on or impregnated into the blanket from the blanket.

6. The plate printing method of claim 4, further comprising a starting third step of, after one of the starting first step and the starting second step, pressing the blanket against the flat dry surface and removing a part of the water or solvent deposited on or impregnated into the blanket from the blanket.

7. The plate printing method of claim 1 wherein the absorbent includes a stack of sheets of paper.

8. The plate printing method of any claim 1, wherein the cleaning surface is one of a surface of paper and an adhesive surface of adhesive tape.

9. A plate printing method comprising a repletion of:

a first of depositing ink on a printing master to form a predetermined print pattern thereon;

a second step of pressing the blanket against the printing master with the ink deposited therein and transferring the ink to the blanket;

a third step of pressing the blanket with the ink transferred therein against a surface to be printed and transferring the ink from the blanket to the surface to be printed;

a fourth step of pressing the blanket after the ink is transferred to the surface to be printed against a flat cleaning surface and depositing the ink remaining in the blanket on the cleaning surface;

a fifth step of pressing the blanket after the remaining ink is deposited on the cleaning surface against an absorbent and depositing or impregnating a part of water or a solvent impregnated into the absorbent on or into the blanket;

a sixth step of, after the fifth step, blowing air to the blanket with the part of the water or solvent deposited therein or impregnated thereinto and removing a part of the water or solvent deposited on or impregnated into the blanket; and a seventh step of, after one of the fifth and the sixth step, pressing the blanket against a flat dry surface and removing a part of the after or solvent deposited on or impregnated into the blanket from the blanket.

10. The plate printing method of claim 9, wherein the absorbent includes a stack of sheet of paper.

11. The plate printing method of claim 9, wherein the cleaning surface is one of a surface of paper and an adhesive surface of adhesive tape.

* * * * *